US007484450B2

(12) United States Patent
Hunn et al.

(10) Patent No.: US 7,484,450 B2
(45) Date of Patent: Feb. 3, 2009

(54) APPARATUS AND METHOD FOR LAUNCHING A VEHICLE

(75) Inventors: David L. Hunn, Kennedale, TX (US); R. Vince Caruth, Ovilla, TX (US); John S. Buchan, Fort Worth, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 108 days.

(21) Appl. No.: 11/360,128

(22) Filed: Feb. 23, 2006

(65) Prior Publication Data

US 2009/0007765 A1 Jan. 8, 2009

(51) Int. Cl.
*F41F 3/00* (2006.01)
*F41F 1/00* (2006.01)
*F41B 11/32* (2006.01)

(52) U.S. Cl. ..... 89/1.818; 124/61; 124/73

(58) Field of Classification Search ..... 89/1.816, 89/1.818, 1.14; 102/440, 479, 498, 529, 102/530; 124/56–61, 73, 74, 75, 76
See application file for complete search history.

(56) References Cited

U.S. PATENT DOCUMENTS 2,703,944 A * 3/1955 Molyneux ..... 43/6
3,119,302 A * 1/1964 Barr ..... 89/1.14
3,404,598 A * 10/1968 Angelos ..... 89/1.14
3,830,214 A * 8/1974 Curtis ..... 124/57
3,858,392 A * 1/1975 Evans et al. ..... 60/637
3,967,552 A * 7/1976 Settles et al. ..... 102/430
4,047,465 A * 9/1977 Wohlford ..... 89/8
4,226,186 A * 10/1980 Peck ..... 102/464
5,333,528 A * 8/1994 Klestadt et al. ..... 89/1.51
5,361,524 A * 11/1994 Karkau et al. ..... 42/1.16
5,372,071 A * 12/1994 Richards et al. ..... 102/378
5,585,596 A * 12/1996 Richards et al. ..... 102/378
5,909,000 A * 6/1999 Rakov ..... 89/7

* cited by examiner

*Primary Examiner*—Bret Hayes
(74) *Attorney, Agent, or Firm*—Daren C. Davis; James E. Walton

(57) ABSTRACT

An apparatus for launching a vehicle includes a bag and an inflator in fluid communication with the bag, the inflator configured to generate a gas to inflate the bag. The apparatus is operable to launch the vehicle. A method for launching a vehicle includes the step of providing an apparatus for launching the vehicle, the apparatus comprising a bag and an inflator in fluid communication with the bag. The method further includes the step of activating the inflator, such that a gas flows from the inflator, and the step of inflating the bag with the gas to launch the vehicle.

10 Claims, 7 Drawing Sheets

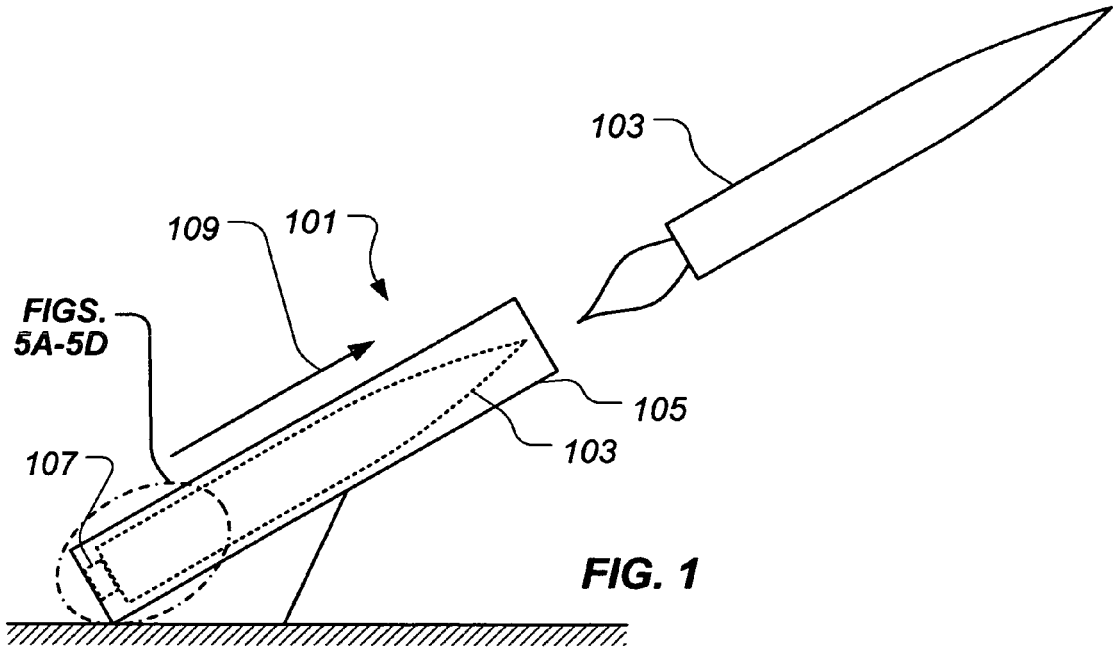
FIG. 1
FIG. 6
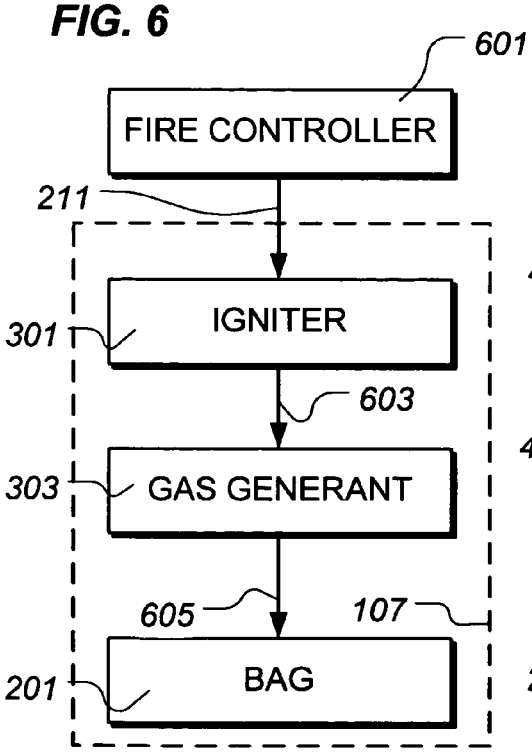
FIG. 7
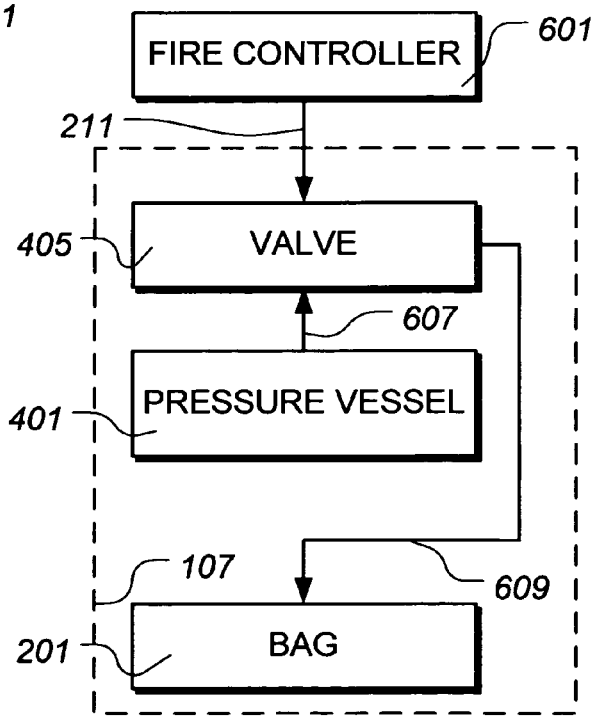

FIG. 2A
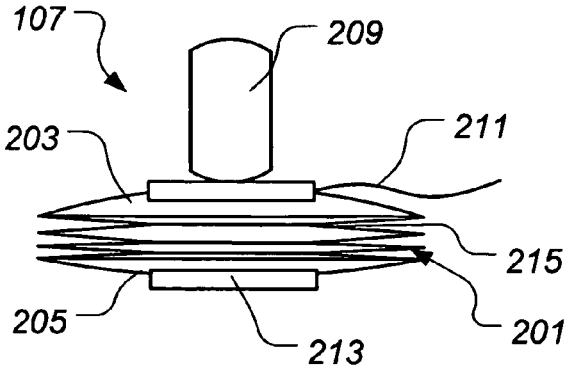
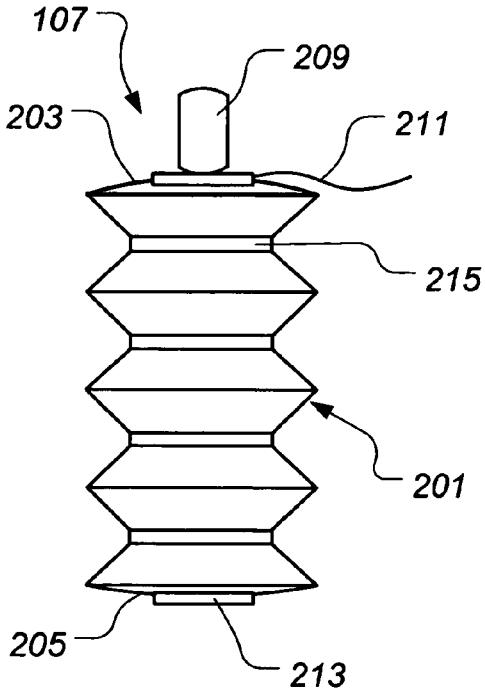
FIG. 2B
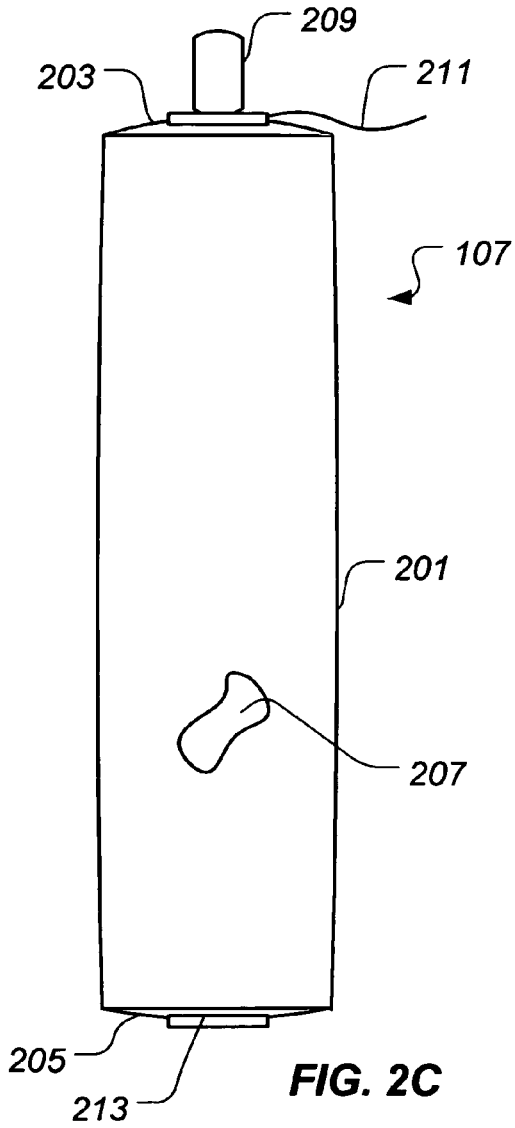
FIG. 2C

APPARATUS AND METHOD FOR LAUNCHING A VEHICLE

BACKGROUND

1. Field of the Invention

The present invention relates to airborne or waterborne vehicles and the launching of such vehicles.

2. Description of Related Art

Vehicles, such as powered munitions, rockets, missiles, projectiles, drones, torpedoes, and the like, are often stored in and deployed from canisters. Deploying such a vehicle typically involves two steps: launching the vehicle from the canister and sending the vehicle toward a target or along a desired path. In some conventional implementations, the vehicle's main engine is fired to launch the vehicle from the canister. In other implementations, an auxiliary engine is fired to launch the vehicle from the canister. Such auxiliary engines employ propellants that produce a high thrust impulse for a short amount of time to launch the vehicle from the canister.

In either case, liquid or solid propellants are combusted to provide the launching impetus. When combusted, such propellants generate soot and/or smoke that often affect the operation of the vehicle. Propellants capable of producing a higher thrust impulse typically generate a larger amount of smoke and/or soot than lower thrust impulse propellants. For example, some canister-launched vehicles incorporate optical sensors that provide inputs to the vehicle's trajectory controller, so that a desired target is defeated. Smoke and/or soot particles often adhere to windows of such vehicles, through which the optical sensors receive inputs. The smoke and/or soot particles decrease the amount of light propagated through the windows and/or alter the light propagated through the windows, thus reducing the effectiveness of the optical sensors.

Moreover, it is critical to prevent any structural damage to the vehicle during expulsion from the canister. Firing the main engine of the vehicle or an auxiliary expulsion engine, within the confined space of the canister, results in unintended consequences at times. For example, if the engine firing is extraordinary, heat produced by the combusting propellant may structurally damage the vehicle. Smoke and/or soot from higher thrust impulse propellants may also damage the vehicle, particularly propulsion and control systems of the vehicle. In particular, if soot and/or smoke are ingested into a propulsion system of the vehicle, the propulsion system may not operate properly or may fail to operate entirely.

Furthermore, conventional launching methods may produce visible and/or thermal signatures that allow an enemy to locate the launch site. For example, enemy personnel may see smoke and/or soot produced by combusting propellant. Moreover, heat generated by high thrust impulse propellants may allow an enemy's sensor system to locate the launch site.

There are many designs of canister-launched vehicles and launch systems thereof well known in the art, however, considerable shortcomings remain.

SUMMARY OF THE INVENTION

There is a need for an improved apparatus and method for launching a vehicle.

Therefore, it is an object of the present invention to provide an improved apparatus and method for launching a vehicle.

These and other objects are achieved by providing an apparatus for launching a vehicle, including a bag and an inflator in fluid communication with the bag, the inflator configured to generate a gas to inflate the bag. The apparatus is operable to launch the vehicle.

In another aspect, the present invention provides an apparatus for launching a vehicle, including a head; a base; a bag extending between the head and the base, such that the head, the base, and the bag define a cavity, the bag defining at least one collapsing feature; and an inflator in fluid communication with the cavity through the head, the inflator being operable to launch the vehicle when the inflator is activated to produce gas that inflates the bag.

In yet another aspect of the present invention, a vehicle system is provided. The vehicle system includes a canister; a vehicle disposed in the canister; and an apparatus for launching the vehicle from the canister. The apparatus includes a bag and an inflator in fluid communication with the bag, the inflator configured to generate a gas to inflate the bag. The bag is disposed between the vehicle and the canister.

In another aspect of the present invention, a method for launching a vehicle is provided. The method includes the step of providing an apparatus for launching the vehicle, the apparatus comprising a bag and an inflator in fluid communication with the bag. The method further includes the step of activating the inflator, such that a gas flows from the inflator, and the step of inflating the bag with the gas to launch the vehicle.

The present invention provides significant advantages, including: (1) providing a means for launching a vehicle while minimizing the likelihood of compromising the structural integrity of the vehicle; (2) providing a means for launching a vehicle while minimizing the likelihood of obscuring sensor windows of the vehicle; (3) providing a means for launching a vehicle while minimizing the likelihood of enemy forces determining the location of the vehicle launch site; and (4) providing a means for launching a vehicle while minimizing the likelihood of damaging propulsion and/or control systems of the vehicle.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

FIG. 1 is a stylized, side, elevational view of an illustrative embodiment of a vehicle system according to the present invention;

FIGS. 2A-2C are side, elevational views of an illustrative embodiment of an apparatus for launching a vehicle according to the present invention;

FIG. 6 is a block diagram illustrating one particular embodiment of a portion of the vehicle system of FIG. 1;

FIG. 7 is a block diagram illustrating one particular embodiment of a portion of the vehicle system of FIG. 1, alternative to the embodiment of FIG. 6;

Figure 3:
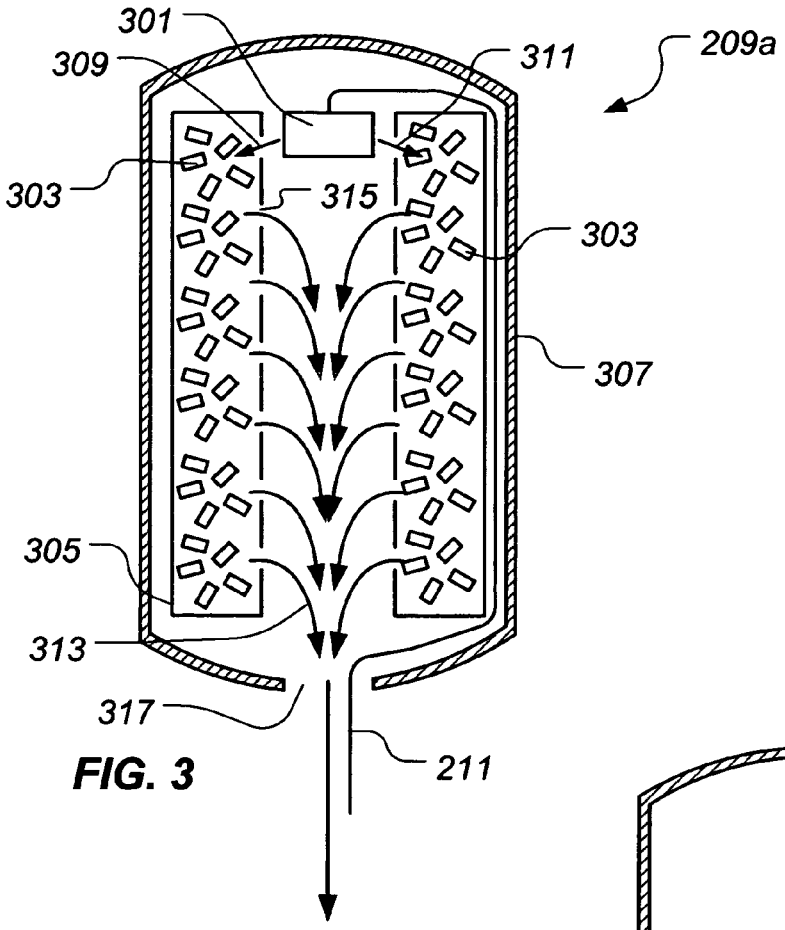
FIG. 3 is a stylized, cross-sectional view of an illustrative embodiment of a gas-generant inflator according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents an apparatus and method for launching a vehicle. The apparatus includes a bag and an inflator in fluid communication with the bag. The inflator may include a gas generant that, when activated, generates a gas to fill the bag or a container of pressurized; or liquefied gas that is gasified to fill the bag. When operated, the apparatus exerts a force on the vehicle sufficient in nature to launch the vehicle. In one embodiment, the apparatus exerts a force on the vehicle sufficient in nature to expel the vehicle from a canister at a velocity adequate to sustain the vehicle in the air until such time as the vehicle's engine or motor is activated to propel the vehicle. In one embodiment, the apparatus is configured to mate with a portion of the vehicle.

FIG. 1 depicts a stylized, illustrative embodiment of a vehicle system 101 according to the present invention. In the illustrated embodiment, vehicle system 101 includes a vehicle 103, a canister 105, and an apparatus 107 for launching vehicle 103 from canister 105. Note that vehicle 103 is represented in hidden line within canister 105 prior to launch and is represented in solid line after vehicle 103 has been launched from canister 105 at the point of main vehicle engine ignition. It should also be noted that vehicle 103 may be any canister-launchable vehicle, such as a rocket, a missile, a powered munition, a drone, a torpedo, or the like. As will be discussed in greater detail below, apparatus 107 is configured to mate with a portion of vehicle 103. Irrespective of the particular configuration illustrated in FIG. 1, vehicle system 101 may be ground-based (i.e., operated from a fixed location) or mobile (i.e., capable of being operated in different locations or while being moved from location to location).

In operation, apparatus 107 launches or expels vehicle 103 from canister 105 in a direction indicated by an arrow 109. Once vehicle 103 is clear (i.e., at least fully expelled from canister 105), a motor or engine of vehicle 103 is activated to propel vehicle along a desired path and/or to a target.

FIGS. 2A-2C depict one particular embodiment of apparatus 107 for launching vehicle 103 from canister 105. FIG. 2A illustrates apparatus 107 in a pre-deployed configuration. FIG. 2B depicts apparatus 107 in a partially deployed configuration and FIG. 2C shows apparatus 107 in a fully deployed configuration. Note that FIG. 2A provides a view of apparatus 107 that is enlarged to a greater degree than the views of FIGS. 2B and 2C for clarity. In the illustrated embodiment, apparatus 107 comprises a bag 201 extending between a head 203 and a base 205. Thus, bag 201, head 203 and base 205 define a cavity 207. Note that, in FIG. 2C, a portion of bag 201 is cut away to reveal cavity 207.

An inflator 209 extends from head 203 and is in fluid communication with cavity 207 via head 203. It should be noted that the scope of the present invention encompasses embodiments wherein head 203 and/or base 205 are omitted. For example, if head 203 and base 205 are omitted, the bag defines cavity 207. In such embodiments, inflator 209 may be directly attached to the bag. Alternatively, inflator 209 may be in fluid communication with cavity 207 via another element of apparatus 107, for example, via base 205. Moreover, inflator 209 may be disposed within cavity 207. In the illustrated embodiment, inflator 209 is activated via a signal (e.g., an electrical or optical signal) conducted or propagated over a cable 211. Preferably apparatus 107 is attached to canister 105 (shown in FIGS. 1 and 5A-5D) at base 205, for example at a flange 213.

Still referring to FIGS. 2A-2C, bag 201 comprises a material having sufficient mechanical strength to successfully expel or launch vehicle 103 from canister 105 without rupturing when inflator 209 inflates bag 201. For example, in one embodiment, bag 201 comprises a fiber-reinforced polymeric material, such as aramid fiber reinforced neoprene. Other constructions of bag 201 are possible, however. For example, bag 201 may comprise a metallic material, an unreinforced polymeric materials, or the like. Bag 201 defines one or more collapsing features, such as one or more pleats 215 (best shown in FIGS. 2A and 2B) that allow bag to occupy a small volume, and preferably a minimum volume, when in the pre-deployed configuration (FIG. 2A). It should be noted that, while the embodiment illustrated in FIGS. 2A and 2B exhibits a particular pleat configuration, the scope of the present invention is not so limited, as the particular pleat configuration will depend upon the particular implementation.

Inflator 209 provides a gas for inflating bag 201. A gas-generant inflator 209*a*, one embodiment of which is depicted in FIG. 3, includes an igniter 301, a gas generant 303, and a baffle 305 disposed in a housing 307. Gas generant 303 is disposed within baffle 305. A signal, carried over cable 211 is received by igniter 301. Igniter 301 is activated and, in turn, heats (as indicated by arrows 309, 311) gas generant 303 to a temperature at which gas generant produces a gas. The gas flows (as indicated by arrows 313, only one labeled for clarity) through orifices 315 (only one labeled for clarity) and an exit port 317 into bag 201 (shown in FIGS. 2A-2C and 5A-5D), thereby generating thrust to launch vehicle 103. While gas generant 303 may comprise many different materials, in one embodiment, gas generant 303 comprises dicyandiamide that, when ignited, produces nitrogen gas, which inflates bag 201.

Figure 4:
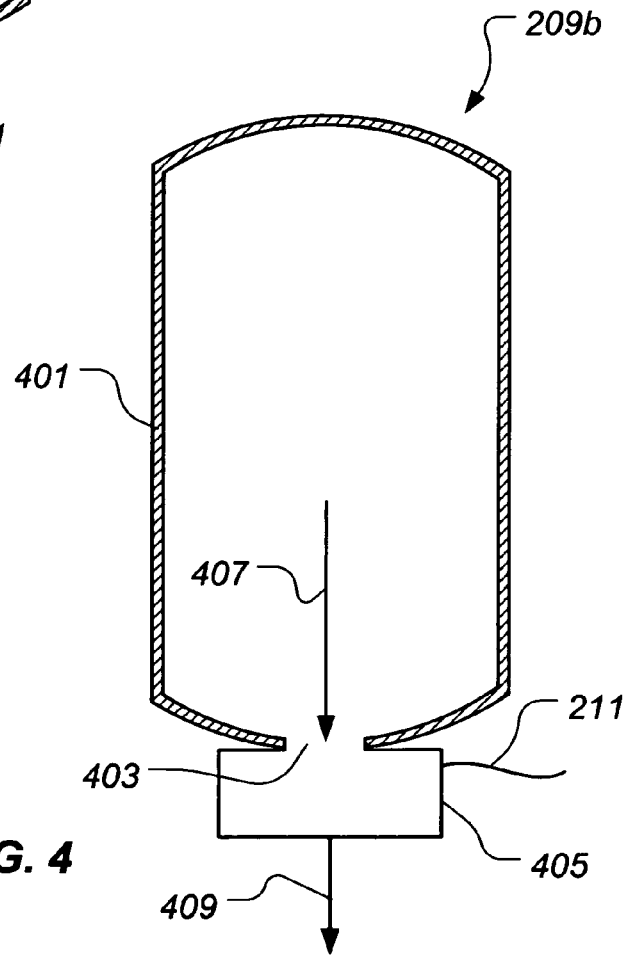
FIG. 4 is a stylized, cross-sectional view of an illustrative embodiment of a compressed gas or liquefied gas inflator according to the present invention.

FIG. 4 illustrates one particular embodiment of a compressed or liquefied gas inflator 209*b*, which comprises a pressure vessel 401, defining an exit port 403, and a valve 405 in fluid communication with pressure vessel 401 via exit port 403. A pressurized or liquefied gas (e.g., nitrogen, argon, or the like) is stored in pressure vessel 401. When a signal, carried over cable 211, is received by valve 405, valve 405 is opened, such that the gas flows (as indicated by arrow 407) from pressure vessel 401, through exit port 403 and valve 405, and into bag 201 (as indicated by arrow 409) to inflate bag 201, thereby generating thrust to launch vehicle 103.

It should be noted, however, that the particular environment and implementation in which the apparatus according to the present invention for launching a vehicle from a canister is used is implementation specific. In particular, the scope of the present invention encompasses bags, heads, bases, initiators, valves, igniters, gas generants, baffles, housings, pressure vessels, exit ports, etc. having configurations different from those illustrated in the drawings.

Figure 5A:
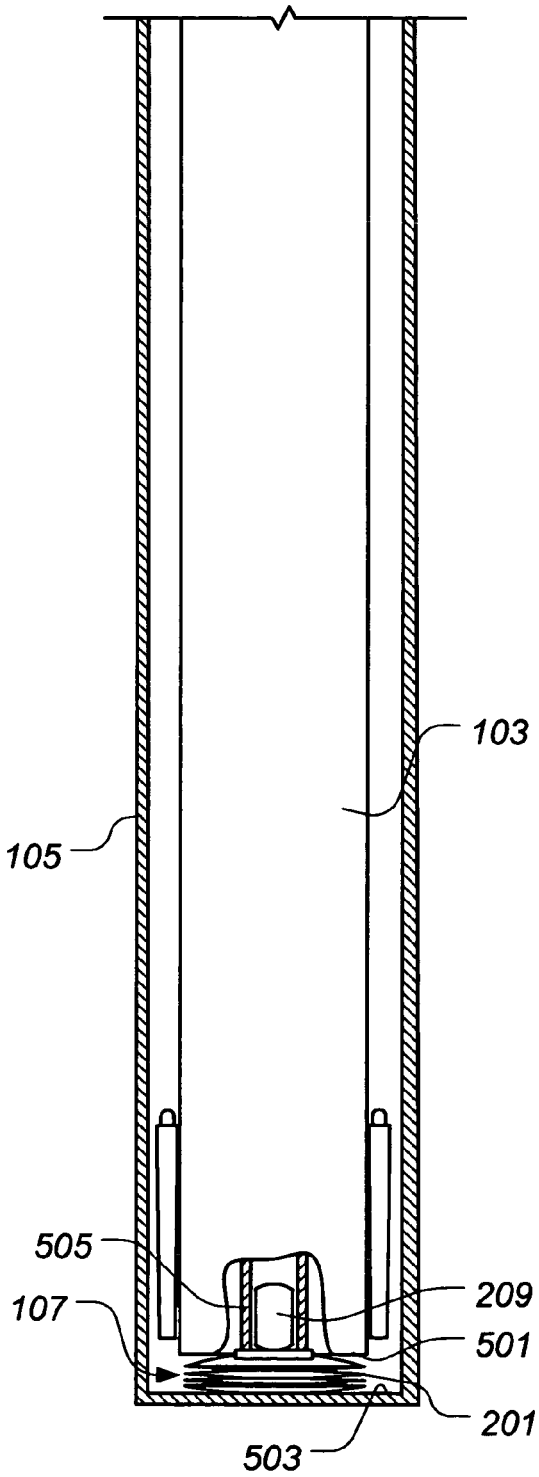
FIGS. 5A-5D are stylized, partial, cross-sectional views of a portion of the vehicle system of FIG. 1 illustrating the operation of the apparatus for launching a vehicle of FIGS. 2A-2C.

FIGS. 5A-5D provide enlarged, partial cross-sectional views, as indicated in FIG. 1, of vehicle system 101 illustrating one particular operation of apparatus 107. Note that vehicle 103 is illustrated in the drawings as a missile or rocket; however, the scope of the present invention is not so limited. Rather, vehicle 103 may take on the form of any canister-launchable vehicle, as discussed above. Referring specifically to FIG. 5A, bag 201 is depicted in a deflated, collapsed state, disposed between an aft end 501 of vehicle 103 and an end 503 of canister 105. In this particular embodiment, inflator 209 is disposed within, and is thus mated with, an exhaust nozzle 505 of vehicle 103, which is open at aft end 501 of vehicle 103. It should be noted, however, that the scope of the present invention encompasses apparatus 107 being configured to mate with any suitable portion of vehicle 103, not merely exhaust nozzle 505. For example, some canister-launched vehicles may not have an exhaust nozzle, such as exhaust nozzle 505. In such vehicles, apparatus 107 mates with another portion of the vehicle and such embodiments are contemplated by the present invention.

Figure 5B:
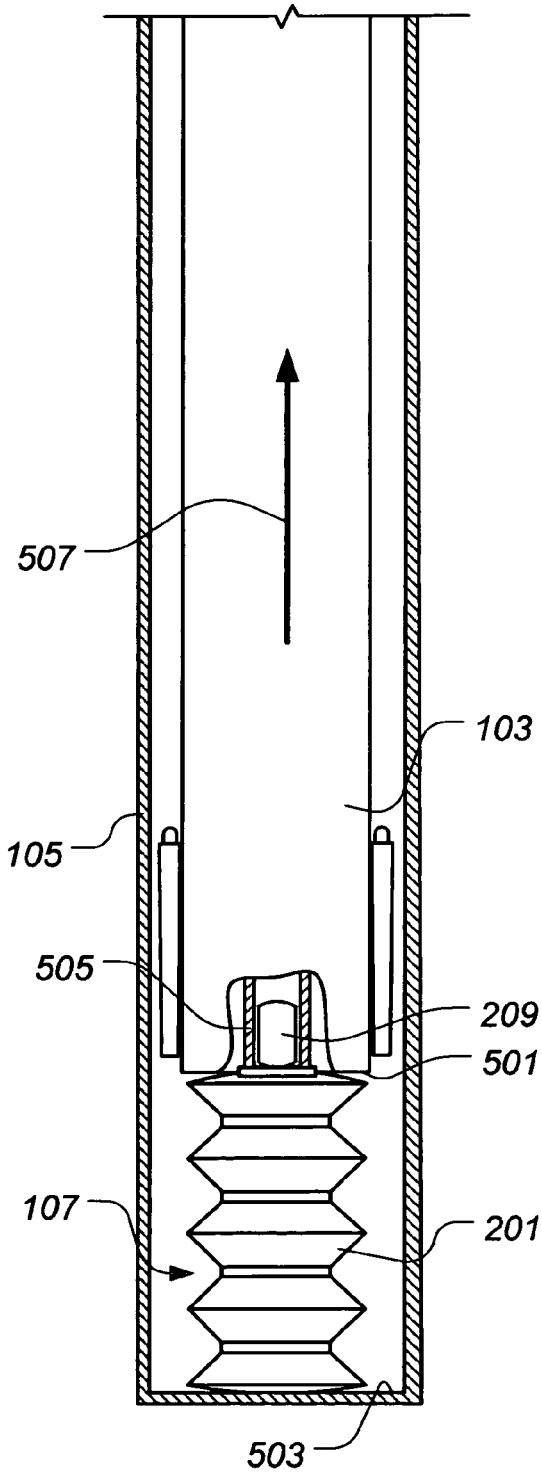
Figure 5C:
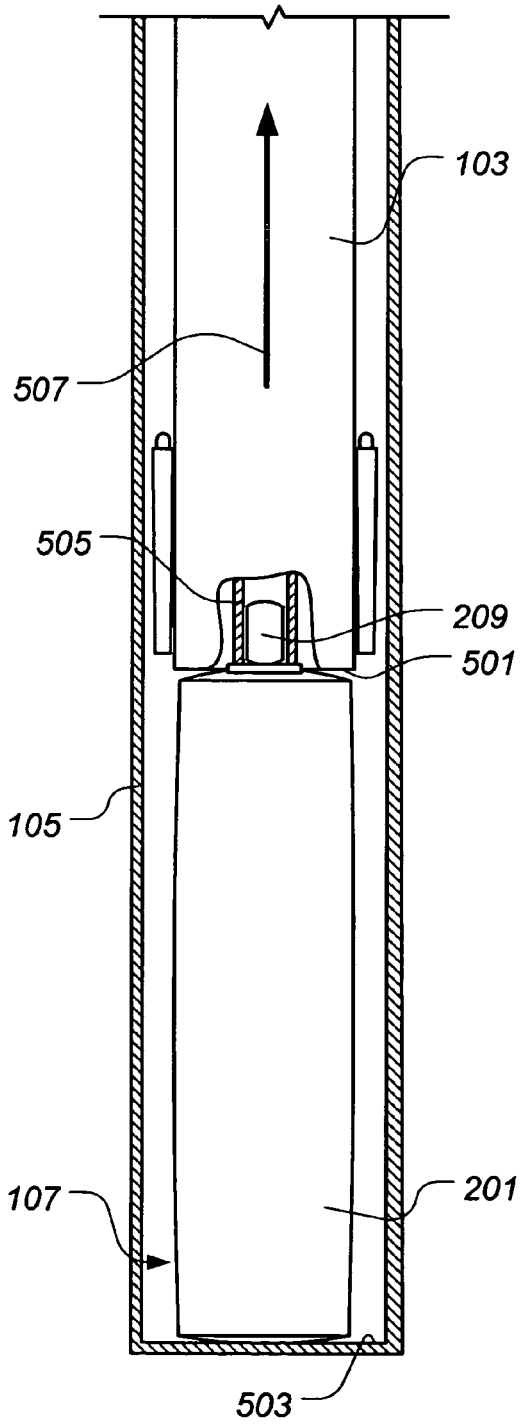
Figure 5D:
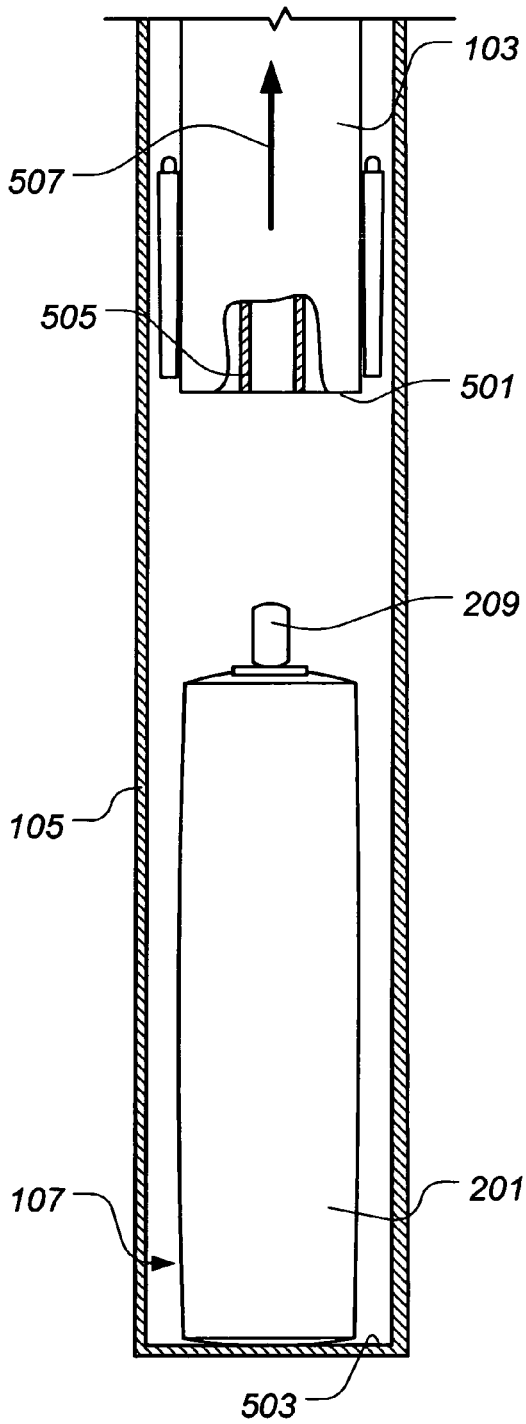

As illustrated in FIG. 5B, vehicle 103 is urged away (as indicated by an arrow 507) from end 503 of canister 105 when inflator 209 is activated and gas from inflator 209 begins to inflate bag 201. FIG. 5C illustrates bag 201 fully inflated, with vehicle 103 continuing to travel away (as indicated by arrow 507) from end 503 of canister 105. As depicted in FIG. 5D, vehicle 103 separates from apparatus 107 and is expelled from canister 105, as illustrated in FIG. 1.

As illustrated in the block diagram of FIGS. 6 and 7, vehicle system 101 further comprises a fire controller 601 operatively associated with apparatus 107. Fire controller 601 oversees, among other things the operation of vehicle system 101 at the time of launch of vehicle 103. Accordingly, in the illustrated embodiments, fire controller 601 operates apparatus 107 to launch vehicle 103 from canister 105. In the particular embodiment of FIG. 6, which corresponds to, for example, the embodiment of inflator 209*a* of FIG. 3, fire controller 601 outputs a signal over cable 211 to igniter 301 that, in turn, ignites (as indicated by an arrow 603) gas generant 303. Gas produced by the ignited gas generant 303 flows (as indicated by an arrow 605) into bag 201 to inflate bag 201, thereby generating thrust to launch vehicle 103. It should be noted that igniter 301, gas generant 303, pressure vessel 301, and/or valve 405 may be disposed external to canister 105.

Alternatively, in an embodiment corresponding to, for example, the embodiment of inflator 209*b* of FIG. 4, fire controller 601 outputs a signal over cable 211 to valve 405, which opens valve 405. Gas from pressure vessel 401 flows (as indicated by an arrow 607) into and through valve 405 and then flows (as indicated by an arrow 609) into bag 201, thereby generating thrust to launch vehicle 103.

Figure 8:
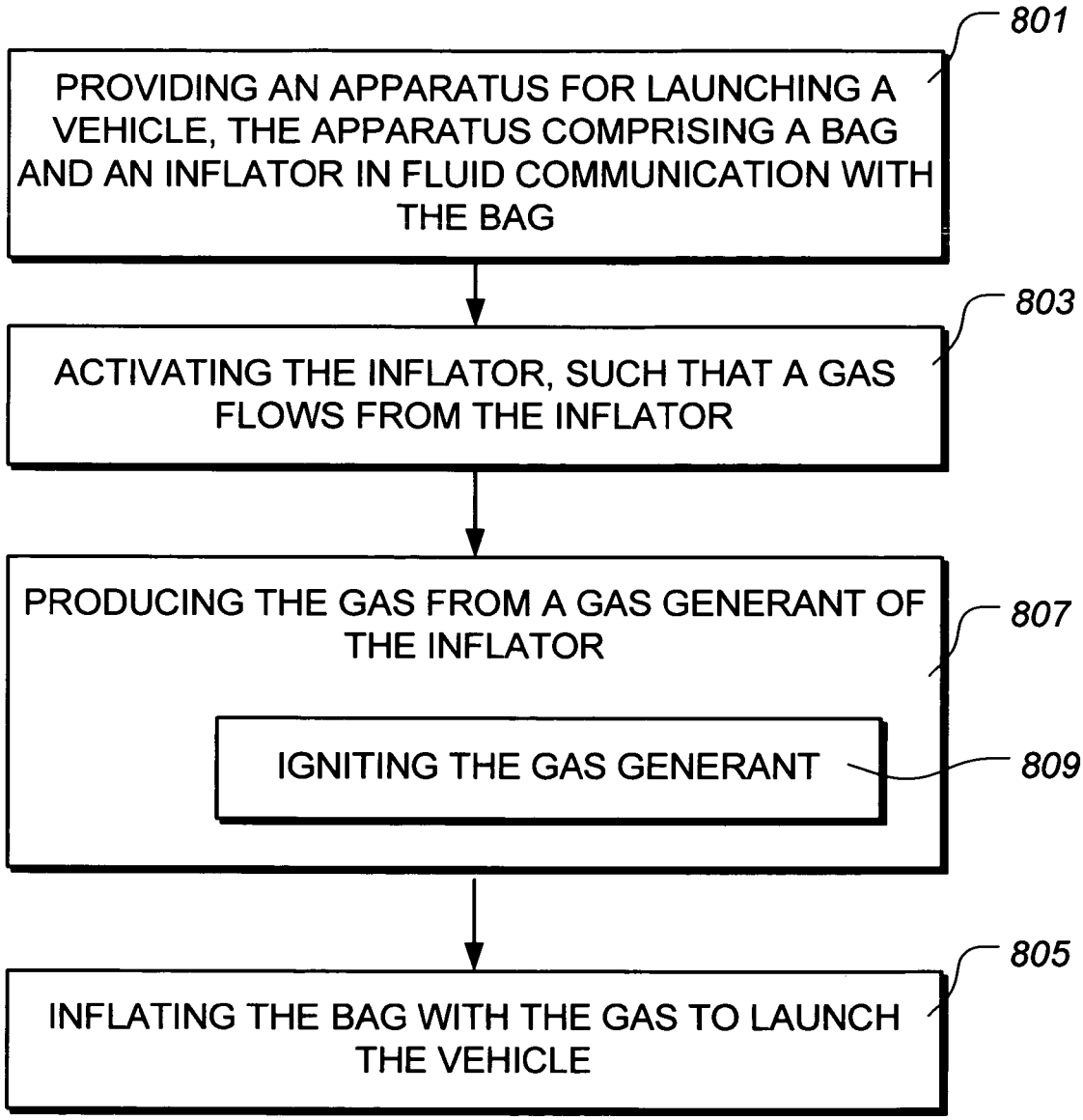
FIG. 8 is a flowchart illustrating one particular embodiment of a method for launching a vehicle according to the present invention.

FIG. 8 depicts one illustrative embodiment of a method for launching a vehicle (e.g., vehicle 103), comprising the steps of providing an apparatus (e.g., apparatus 107) for launching the vehicle, the apparatus comprising a bag (e.g., bag 201) and an inflator (e.g., inflator 209, 209*a*, or 209*b*) in fluid communication with the bag (block 801). The method further comprises the step of activating the inflator, such that a gas flows from the inflator (block 803); and the step of inflating the bag with the gas to launch the vehicle (block 805).

In one embodiment, the method further comprises the step of producing the gas from a gas generant of the inflator (block 807). In another embodiment, the step of producing the gas from the gas generant (block 807) comprises the step of igniting the gas generant (block 809).

Figure 9:
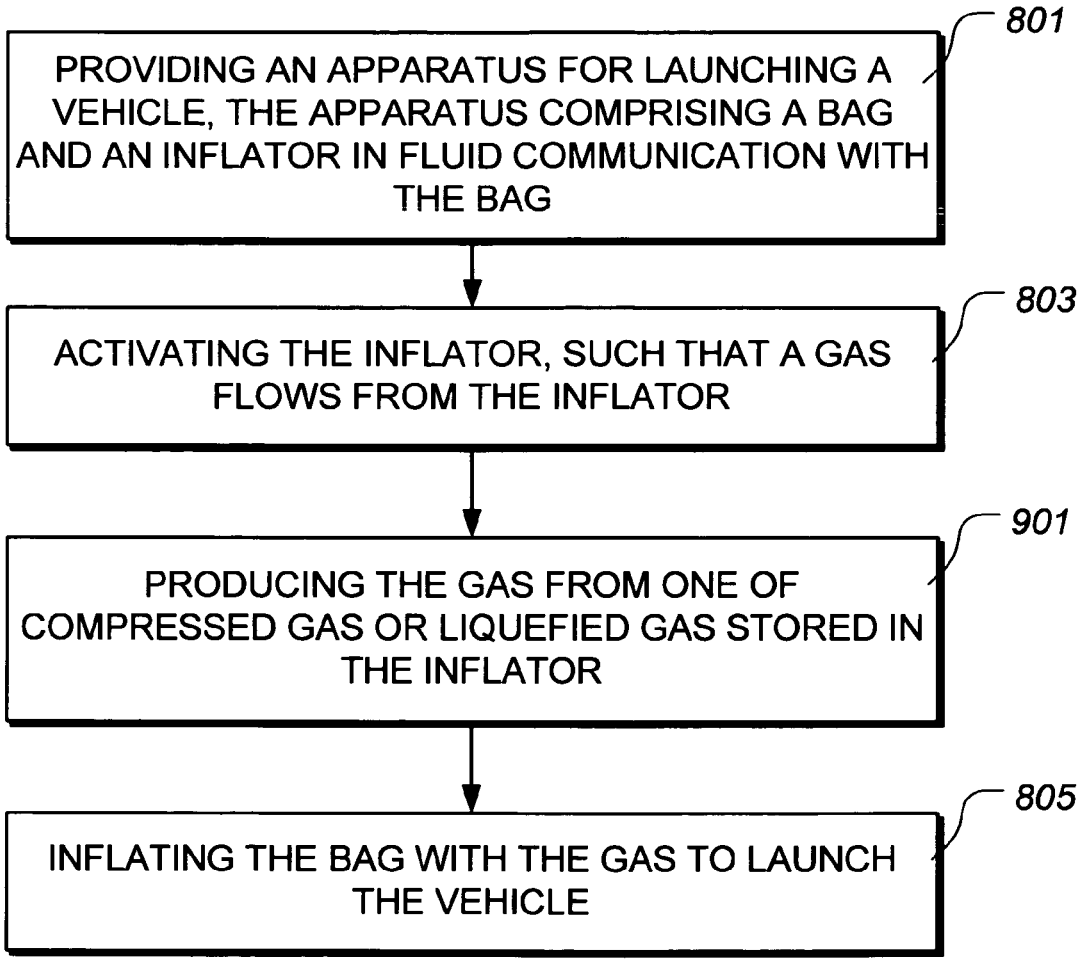
FIG. 9 is a flowchart illustrating one particular embodiment of a method for launching a vehicle according to the present invention, alternative to the embodiment of FIG. 8.

In yet another illustrative embodiment, depicted in FIG. 9, a method for launching a vehicle comprises the step of producing the gas from one of compressed gas or liquefied gas stored in the inflator (block 901) instead of the step of producing the gas from the gas generant of the inflator (block 807 of FIG. 8). Other steps of the method correspond to those illustrated in FIG. 8.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An apparatus for launching a vehicle, comprising:

a bag; and a gas-generant inflator in fluid communication with the bag, the inflator configured to generate a gas to inflate the bag, the gas generant inflator comprising:

a housing defining an exit port;

a baffle;

a gas generant disposed in the baffle; and an igniter disposed in the housing and operably associated with the gas generant;

wherein the igniter, when activated, ignites the gas generant to produce a gas; the gas flows through the baffle and the exit port to inflate the bag; and the apparatus is operable to launch the vehicle.

2. The apparatus, according to claim 1, wherein the apparatus is configured to mate with the vehicle.

3. The apparatus, according to claim 1, wherein the inflator is configured to mate with an exhaust nozzle of the vehicle.

4. The apparatus, according to claim 1, wherein the bag defines at least one collapsing feature.

5. The apparatus, according to claim 1, wherein the bag comprises:

a fiber-reinforced, polymeric material.

6. The apparatus, according to claim 1, further comprising:

a head, through which the inflator is in fluid communication with the bag; and a base;

wherein the head, the base, and the bag define a cavity into which gas from the inflator is received to inflate the bag.

7. The apparatus, according to claim 1, wherein the apparatus is operably associated with a vehicle system.

8. The apparatus, according to claim 1, wherein the apparatus is operably associated with a fire controller.

9. A vehicle system, comprising:

a canister;

a vehicle disposed in the canister; and an apparatus for launching the vehicle from the canister, the apparatus comprising:

a bag; and a gas-generant inflator in fluid communication with the bag, the inflator configured to generate a gas to inflate the bag, the gas generant inflator comprising:

a housing defining an exit port;

a baffle;

a gas generant disposed in the baffle; and an igniter disposed in the housing and operably associated with the gas generant;

wherein the igniter, when activated, ignites the gas generant to produce a gas; the gas flows through the baffle and the exit port to inflate the bag; and the bag is disposed between the vehicle and the canister.

10. The vehicle system, according to claim 9, further comprising:

a fire controller operably associated with the apparatus for launching the vehicle from the canister.

* * * * *